US005937629A

United States Patent [19]

Spindler et al.

[11] Patent Number: 5,937,629

[45] Date of Patent: Aug. 17, 1999

[54] METHOD AND DEVICE FOR SUPPLYING EMPTY TUBES TO WINDING DEVICES OF A TEXTILE MACHINE

[75] Inventors: Zdenek Spindler, B. Nemcove; Zbynek Vencl, Mazankova; Vojtech Novotny, Dukelska, all of Czech Rep.

[73] Assignee: Rieter Elitex A.S. Usti Nad Orlici, Czech Rep.

[21] Appl. No.: 08/518,186

[22] Filed: Aug. 23, 1995

[30] Foreign Application Priority Data

Aug. 24, 1994 [CS] Czechoslovakia ..... 2054-94

[51] Int. Cl.[6] ..... D01H 9/10

[52] U.S. Cl. ..... 57/281; 57/90; 57/266; 57/268; 57/270; 57/271; 57/272; 57/275; 57/276; 242/473.4; 242/473.5; 242/473.6; 242/473.7; 242/474

[58] Field of Search ..... 57/281, 90, 266, 57/268, 270, 271, 272, 275, 276; 242/35.5 A, 473.4, 473.5, 473.6, 473.7, 474

[56] References Cited

U.S. PATENT DOCUMENTS

| | | | |
|---|---|---|---|
| 4,040,573 | 8/1977 | Burysek et al. | 57/270 |
| 4,595,151 | 6/1986 | Slavik et al. | 242/473.6 |
| 4,598,881 | 7/1986 | Lattion | 242/473.6 |
| 4,865,260 | 9/1989 | Colli et al. | 242/35.5 A |
| 4,907,755 | 3/1990 | Burysek et al. | 242/35.5 A |
| 5,168,695 | 12/1992 | Stahlecker | 57/281 |
| 5,199,254 | 4/1993 | Badiali et al. | 57/90 |
| 5,396,758 | 3/1995 | Spinder et al. | 57/263 |
| 5,426,930 | 6/1995 | Badiali et al. | 57/90 |
| 5,634,603 | 6/1997 | Raasch et al. | 57/281 |

FOREIGN PATENT DOCUMENTS

| | | | |
|---|---|---|---|
| 261150 | 5/1989 | Czechoslovakia . | |
| 54-106630 | 8/1979 | Japan | 57/281 |
| 2223033 | 3/1990 | United Kingdom | 57/268 |

*Primary Examiner*—William Stryjewski
*Attorney, Agent, or Firm*—Dority & Manning

[57] ABSTRACT

A method and device are provided for supplying empty tubes to winding devices of a textile machine comprising a plurality of operating units arranged next to each other in at least one line and equipped each with a winding device as a part of the operating unit, with a tube container provided at one end of the machine and coupled with a tube conveyer arranged along the line of the operating unites of the textile machine along which is also provided an attending unit adapted to travel along the line of the operating units and containing a handling device for moving a tube from the tube conveyer to a winding device. Prior to the attempt at rewinding, the handling device of the attending device lays into the winding device an empty winding tube. In case of an unsuccessful attempt at rewinding (at restoring the winding), the winding tube 22 is taken out of the winding device 1 by the attending device 4.

14 Claims, 7 Drawing Sheets

METHOD AND DEVICE FOR SUPPLYING EMPTY TUBES TO WINDING DEVICES OF A TEXTILE MACHINE

BACKGROUND OF THE INVENTION

The present invention relates to a method of supplying empty tubes to winding devices of a textile machine, such a textile machine comprising a plurality of operating units arranged next to each other in at least one line and each equipped with a winding device as a part of the operating unit. At one end of the machine there is provided a tube container coupled with a tube conveyer arranged along the line of the operating units of the textile machine along which is also provided an attending unit adapted to travel along the line of the operating units. The attending unit contains handling means for moving a tube from the tube conveyer to a winding device, the handling means of the attending device laying into the winding device an empty winding tube prior to an attempt at rewinding. The invention also relates to a device for carrying out the method on a textile machine. The invention also relates to a device for stopping a tube on the conveyor for carrying out said method on a textile machine.

In automatic textile machines in which yarn or thread being produced is wound on a bobbin at each operating unit of the machine, the bobbin, when (fully) wound, must be removed from the operating unit and replaced by an empty tube. This replacement of a (fully) wound bobbin by an empty tube can be made manually or by means of an automatic attending device that, however, must be equipped with an empty tube ready to be inserted at the moment of said replacement.

There are known a number of methods for conveying tubes to the operating units of a textile machine. In one of them, the attending device carries a number of tubes along with it. Its drawback consists in the necessity to replenish the inevitably limited total number of tubes in the attending device thus cutting down the productivity of the attending device. Besides, the tubes, can fall out of the container of the attending device while the latter is moving from an operating unit to a next one.

Also known are systems of tube conveying in which one tube, currently replenished, is seated at each operating unit. The conveying proper is provided for, for instance, by means of chain or through conveyers. The chief drawback consists in the complicated state of the conveying and depositing means, which contain a large number of repeating components having high trouble incidence.

The drawbacks of the above tube conveying systems have been eliminated by a device disclosed in the patent U.S. Pat. No. 4,865,260 for distributing and delivering separate tubes, one at a time, to the winding units of a textile machine. The tubes are seated in the container separately on a moving device, and more specifically, on a conveyer equipped with pins on which the tubes are seated without being in mutual contact. From the container, the tubes are doffed with a doffing device and transferred on the conveyer by which they are in their axial position, one at a time, transferred to gripping means adapted to stop the tube on the conveyer and to take it from the conveyer.

The device for conveying tubes disclosed in the CS AO 261 150 improved against the preceding device by positioning the tube stopped by means of the device on the conveyer to the position in which the projection of the tube axis to the active element of the conveyer is parallel with the direction of motion of this element. However, this modification complicates the device and does not eliminate the risk for the conical tube to fall out due to the oscillations of its narrow flange between the stationary passive members of the conveyer.

In operation, in such device the attending device fist stops at the winding unit where the full bobbin has to be replaced by a tube, and asks for a tube from the container. A tube is then released from the container and fed by the conveyer to the attending device that grips it with its receiving member and hands it over to its inserting member that puts it into bobbin arms of the winding device. Thereupon, yarn of thread is fixed to the tube, and the winding process is resumed.

If the resumption of the winding process has been unsuccessful, the empty tube remains gripped between the bobbin arms, and the attending device qualifies the operating unit in question as unattendable and moves to a next operating unit in need of attendance. The operating unit qualified as unattendable must be taken care of by an operator whose task is not only to remove the fault that has rendered impossible the rewinding, but also to take the tube out of the bobbin arms of the winding device and take it away.

Similar disadvantages has also the device for supplying empty tubes to the attending device disclosed in CS AO 261 150, in which the attending cycle is shortened, as compared with the previous method, in that in the handling arms of the attending device there is seated one tube so that there is no need for the attending device to wait until it receives a tube asked for by the attending device from the container but it can immediately proceed to attend the winding device of the operating unit in question. After the tube has been handed over between the bobbin arms of the winding device, the handling arms of the attending device grip the empty tube supplied in the meantime from the container by the conveyer and stopped by the stop mechanism of the attending device on the conveyer. The handling arms of the attending device assume an intermediate transport position, and the attending device is ready to attend another operating unit.

In this method as well, in case of an unsuccessful attempt at rewinding, the tube remains seated between the bobbin arms of the winding device and it is up to the operator to remove it. Since for instance spinning or winding machines contain a large number of operating units, and one operator has to take care of several machines, the carrying over of a considerable number of empty tubes is not only time-consuming but also potentially dangerous because the tubes, while being carried over, can fall on the machine or into the attending device and produce a failure in them.

OBJECTS AND SUMMARY OF THE INVENTION

The above drawbacks of the state of art are eliminated by the present invention, a principal object of which is to provide a method of supplying empty tubes to a winding device of a textile machine wherein, in case of an unsuccessful attempt at rewinding, the winding tube is taken out of the winding device by the attending device. Additional objects and advantages of the invention will be set forth in part in the following description, or may be obvious from the description, or may be learned through practice of the invention.

In the following attempt at rewinding, the same winding tube is laid into the winding device. If the attempt at rewinding has failed, no tube remains in the winding device by which the following attendance of the operating unit is simplified.

The empty tube can be laid into the handling means of the attending device before the arrival of the attending device at the attended operating unit of the machine and thus avoiding the risk that the attending device will have to wait for supplying the tube to the handling means and in this way increase the attendance time of an operating unit.

Preferably, the tube is taken out of the winding device by the handling means of the attending device in which it remains ready for the next inserting into the winding device.

Preferably, after an unsuccessful attempt at rewinding, the yarn windings are removed from the winding tube whereby the winding tube becomes perfectly ready for the repetition of the inserting operation into the winding device, and the preceding method is improved in quality.

The rest of the yarn windings can be removed from the winding tube after or before the tube has been taken out of the winding device.

The rest of the yarn windings can be removed by suction which, is in most cases, sufficient for the removal of the material from the winding tube.

In a preferred version of the method in which, if there is no reserve tube present on the tube conveyer, at least before the end of the attempt at rewinding, there is sent an empty reserve tube from the tube container by means of the tube conveyer to the attending device which stops the reserve tube and puts it into the gripping position, the principle consists in that after an unsuccessful attempt at rewinding at the attended operating unit, the reserve tube is released from the attending device and kept seated on the tube conveyor, whereas after a successful attempt at rewinding the reserve tube on the tube conveyer is gripped by the handling means of the attending device in which it remains ready as a winding tube for the further operation of inserting the winding tube into the winding device.

The reserve tube kept (left) by the attending device on the tube conveyer can be, according to one preferred variant, moved to the beginning of the tube conveyer and wait there until it is again called in by the attending device. This cycle is repeated until the reserve tube has been taken over by the handling means of the attending device after a successful attempt at rewinding an empty winding tube.

According to another variant, the reserve tube left by the attending device on the tube conveyer can wait on the spot for the following calling-in by the attending device, that examines the mutual position of the attending device and of the reserve tube on the conveyer as a basis for choosing the direction of the motion of the conveyer after the reserve tube has been called-in in case of need. This cycle is repeated until the reserve tube has been taken over by the handling means of the attending device after a successful attempt at rewinding an empty winding tube.

The reserve tube left by the attending device on the tube conveyer after an unsuccessful attempt at rewinding follows the attending device after each arrival at each operating unit to be attended. There, the reserve tube is stopped by the attending device and set into the gripping position. This cycle is repeated until the reserve tube has been taken over by the handling means of the attending device after a successful attempt at rewinding an empty winding tube.

In another preferred variant of the carrying out of the method in which, if there is no reserve tube present on the tube conveyor, at least before the end of the attempt at rewinding, there is sent an empty reserve tube from the tube container by means of the tube conveyer to the attending device which stops the reserve tube and puts it into the gripping position. After an unsuccessful attempt at rewinding at the attended operating unit, the reserve tube is left in its gripping position in the attending device by which it is moved (displaced) on the tube conveyer, and this cycle is repeated until the reserve tube has been taken over by the handling means of the attending device after a successful attempt at rewinding on the empty winding tube.

Preferably, after the gripping of the reserve tube seated on the tube conveyer, another tube from the tube container is laid on the tube conveyer and remains there as a reserve tube for displacement to the attending device.

The tube from the tube container can be laid on the tube conveyer after the attending device has arrived at the next operating unit to be attended so that it can be immediately called-in by the attending device in case of need, i.e., at the beginning of an attempt at rewinding, thus ensuring that even in long machines the tube arrives at the attending device always in time before the end of the respective operating cycle.

In another embodiment, if there is no reserve tube present on the tube conveyer, there is sent an empty reserve tube from the tube container by means of the tube conveyer to the attending device which stops the reserve tube and puts it into the gripping position. The empty reserve tube is sent to the attending device after it has been established that the attempt at rewinding on the empty winding tube was successful. The attending device can take over the reserve tube during the travel of the attending device to the next operating unit to be attended or only after the arrival at such operating unit of the machine.

In double-sided textile machines in which the attending device attends both machine sides, it is advantageous if the attending device, when passing from one machine side to another, stores information about the machine side it is leaving, and recalls information about the machine side it is beginning to attend.

The principle of the device for carrying out the above method of supplying empty tubes to winding devices of a textile machine consists in that the tube conveyer is equipped with a reversing drive coupled with a control unit of an attending device, said control unit being coupled with a sensor monitoring the beginning of the rewinding on the operating unit in question and comprising means monitoring the presence of a winding tube in handling means of the attending device.

In a preferred embodiment of the device, the means monitoring the presence of a winding tube in the handling means of the attending device can be made as a device for monitoring the motion of the handling means.

In this, there is preferably related to the tube conveyer at least one means, coupled with the control unit, for monitoring the tube presence on the tube conveyor.

The means for monitoring the tube presence on the tube conveyor can be made as a sensor which senses the presence of a reserve tube on the tube conveyer situated in stop means of the attending device and/or at the beginning of the tube conveyer.

In some embodiments, it is advantageous if the control unit comprises at least one means for monitoring the mutual position of the reserve tube seated on the tube conveyer and of the attending device.

In this, it is advantageous for double-sided machines if the control unit further comprises means for storing and recalling information at least about the mutual position of the reserve tube seated on the tube conveyer and of the attending device separately for each machine side.

The principle of the device for stopping the tube on the conveyer for carrying out the method of supplying empty tubes to winding devices according to the invention consists in that it contains two stop pins arranged on the attending device which are movable into the path of the reserve tube on the tube conveyer, the stop pins being independently coupled with the control unit. The stop pins can end with conical stops.

In this, in one preferred embodiment, the stop pins can be seated in parallel, in such a position that the distance between the axes of their conical stops its superior to the length of the tube and inferior to the sum of the tube length and the maximum diameter of the conical stop.

In another preferred embodiment, the axes of said stop pins can form an acute angle, their mutually nearest surface lines being parallel and their distance in the moved-out position of the stop pins being equal to the tube length.

The stop pins can also end with cylindrical stops in which the minimum distance of the surface planes of the cylindrical stops is equal to the tube length.

The embodiments of the stop pins and their stops permit transporting the tube to the attending device from each side without complications accompanying its stopping and setting to its gripping position.

In another embodiment of the device for stopping the tube on the conveyer, a fixed stop is mounted on the attending device reaching into the path of the reserve tube on the tube conveyer and having related thereto a double-arm lever swingingly mounted on the attending device.

For double-sided textile machines, the device can be arranged in such a manner that the fixed stop and the double-arm lever are mounted on the attending device swingingly around a common axis.

The principle of another alternative embodiment of the device contains a movable stop mounted on the attending device which is displaceable into the path of travel of the reserve tube on the tube conveyer and that on the displacingly arranged stop there is swingingly mounted a double-sided stop lever.

For double-sided textile machines, this device can be arranged in such a manner that the movable stop is seated swingingly (rotatably) on the attending device.

BRIEF DESCRIPTION OF THE DRAWINGS

Examples of embodiments of the device for carrying out the method according to the invention are schematically shown in the enclosed drawings in which.

DETAILED DESCRIPTION OF THE PREFERRED EMBODIMENTS

Figure 1:
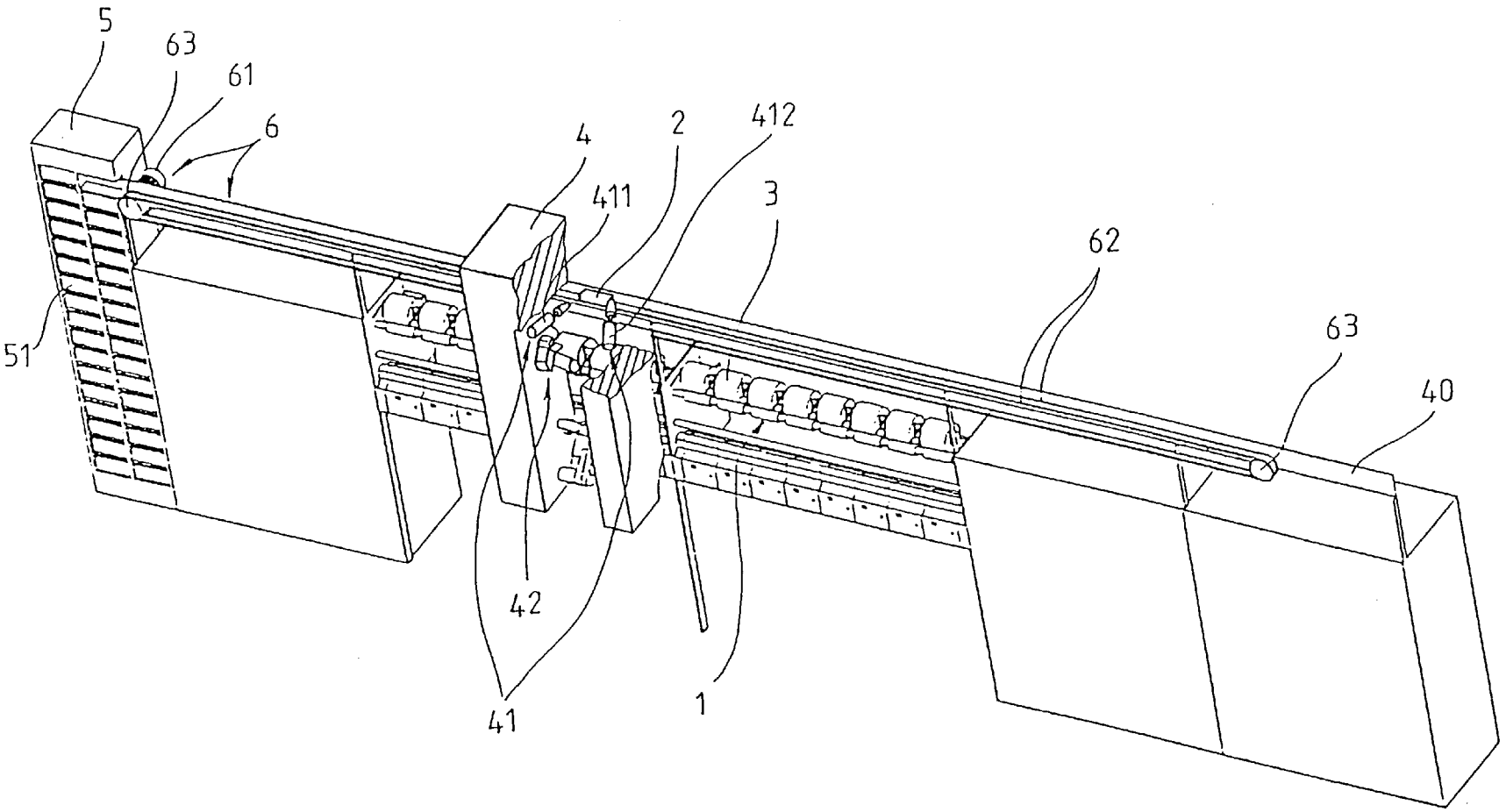
FIG. 1 is a view of a rotor spinning machine with an attending device.

Reference will now be made in detail to the presently preferred embodiments of the invention, one or more examples of which are illustrated in the drawings. Each example is provided by way of explanation of the invention, and not meant as a limitation of the invention. For example, features illustrated or described as part of one embodiment, can be used on another embodiment to yield a still further embodiment.

The method of supplying empty tubes to winding devices of a textile machine is applicable to all such kinds of textile machines in which a linear textile formation, such as yarn, thread or textile fiber, is to be would on a bobbin and which are fitted with an attending device serving, among others, for resuming the winding process on an operating unit of the machine. The method will be described for illustrative purposes on a rotor spinning machine comprising a plurality of operating units arranged next to each other in a line or, possibly, in two lines. Each operating unit of a rotor spinning machine comprises well-known (not shown) mechanisms used to transform a sliver into yarn 7 known as spinning units from which the yarn 7 is drawn-off by a well-known draw-off device and led into a winding device 1 in which the yarn 7 or thread is wound on a tube mounted in winding arms 11 and becomes a bobbin 3. The textile machine is equipped with an automatic attending device 4 adapted to travel on a track 40 along the operating units of the machine. In case of a double-sided machine, usual in the technical practice, the tracks 40 for the attending device 4 are provided on each machine side, and at one or each end they are interconnected by a not shown connecting arc on which the attending device 4 can pass from one machine side to the other one. At one machine end there is provided a tube container 5 having related thereto a tube conveyer 6 extending over at least the whole length of the operating units of the machine and, for design reasons, as a rule still farther. In the embodiment shown in FIG. 1, tubes 2 are seated in the container 5 separately, without mutual contact, in compartments 51 whose position within the tube container 5 is adjustable. The tube container 5 contains a not shown mechanism for individually distributing the tubes 2 from the compartments 51 of the tube container 5 onto the tube conveyer 6 by which each tube 2 is separately transported to the attending device 4. The tube conveyer 6 is equipped with a reversing drive 61. The tube 2 seated on the tube conveyer 6 will be henceforth referred to as reserve tube 21.

Figure 8:
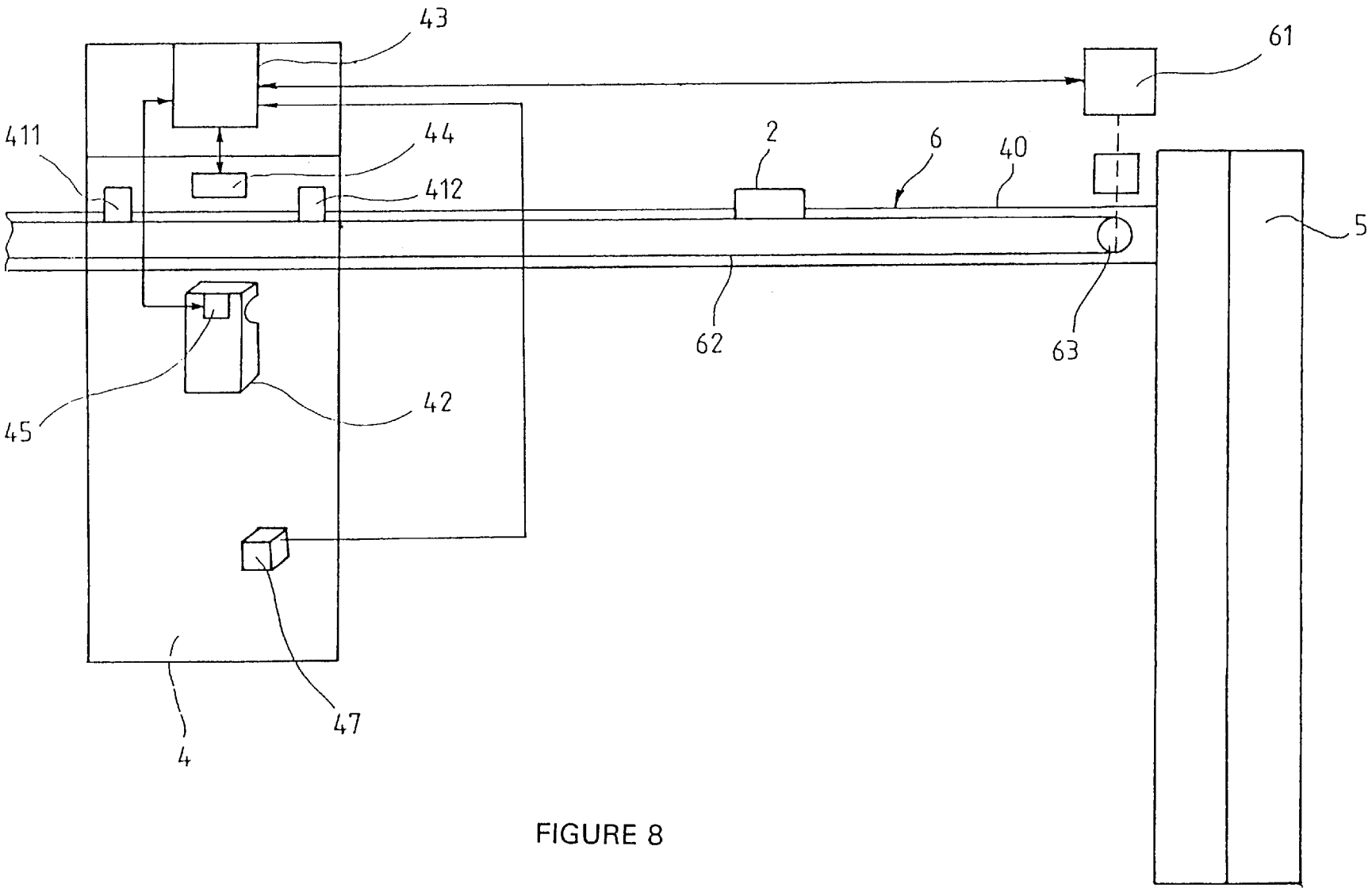
FIG. 8 shows schematically the position of the sensors on the machine and on the attending device.

Besides other mechanisms, the attending devise 4 is fitted with a stop means 41 for stopping the reserve tube 21 on the tube conveyer 6 and with at least one handling means 42 for gripping the reserve tube 21 on the tube conveyer 6 and for transporting it into the winding device 1. After the reserve tube 21 has been gripped by the handling, means 42 and inserted into the winding device 1, the tube 2 will be henceforth referred to as winding tube 22. The handling means 42 is adapted to receive the winding tube 22 also during the travel of the attending device 4 along the textile machine. The attending device 4 is also equipped with a control unit 43 (FIG. 8) connected with both the reversing drive 61 of the tube conveyer 6 and with the tube container 5 and serving to control both of them. Also provided on the attending device 4, and more specifically on the spot where the reserve tube 21 is to be stopped on the tube conveyer 6, is a sensor 44 for sensing the presence of the reserve tube 21 on the tube conveyer 6, in a well-known way interconnected with the control unit 43. This sensor 44 of the presence of the reserve tube 21 on the tube conveyor 6 is in the shown embodiment made as a capacity transducer, but another well-known suitable sensor is also applicable. The sensor 44 serves to monitor the presence of the reserve tube 21 on the tube conveyer 6 after it has been stopped by the stop means 41 of the attending device 4.

To the handling means 42 is related a sensor 45 monitoring the presence of the winding tube 22 in the handling means 42. Sensor 45 can be a part of the handling means 42, e.g., it can be seated in its gripping member 421, or it can be mounted on the attending device 4, and it serves for monitoring the presence of the winding tube 22 in the handling means 42, in particular in its traveling position, and also can consist of the well-known capacity transducer. In some embodiments, the gripping member 421 can be mounted in the handling means 42 movably.

In some alternative embodiments, the sensor 44 of the presence of the reserve tube 21 on the tube conveyer 6 can be omitted. It will be sufficient to use the sensor 45 of the presence of the winding tube 22 in the handling means 42 which detects the presence of the tube 2, referred to as winding tube 22, in the handling means 42 while/after the reserve tube 21 is being/has been taken over from the tube conveyer 6 by the handling means 42.

The stop means 41 of the attending device 4 contains two stop pins 411 and 412 that are individually (separately from each other) connected to the control unit 43. In the embodiment shown in FIGS. 1, 4, and 5, the stop pins 411, and 412 are movable into the path of travel of the reserve tube 21 on the tube conveyer 6, and are placed obliquely to each other in such a position that their axes or the directions of their motion respectively lie in a plane passing through the stopped reserve tube 21 seated on the tube conveyer 6, and form with each other an acute angle whose apex, viewed in the direction from the attending device 4, lies behind the reserve tube 21 seated on the tube conveyer 6. If the side of the attending device 4 lying to the left when viewing the attending device 4 from outside the machine is designated as the left side, and the opposite side as the right side, there will be, on the left side of the attending device 4 the left-side stop pin 411, and on the right side of the right-side stop pin 412.

The stop pin 411, 412 consist of well-known air cylinders connected to the control device, each piston rod of the air cylinder having at its end a conical stop 413. The distance between the surface of the conical stops 413 of the stop pins 411, 412 in their moved-out positions is at least at one spot equal to the length of the tube 2 so that, when the two stop pins 411, 412 are in their moved-out positions, the reserve tube 21 on the tube conveyer 6 is fixed between the conical stops 413, and its position defined for being gripped by the handling means 42.

Figure 5:
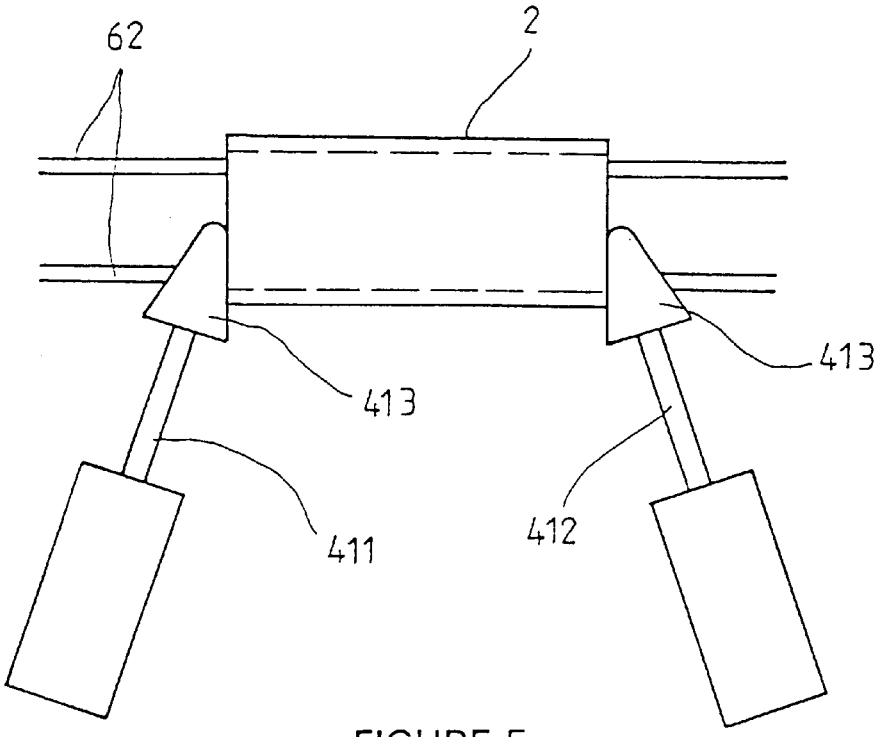
FIG. 5 is the stop means of the FIG. 4 with a positioned tube.
Figure 4:
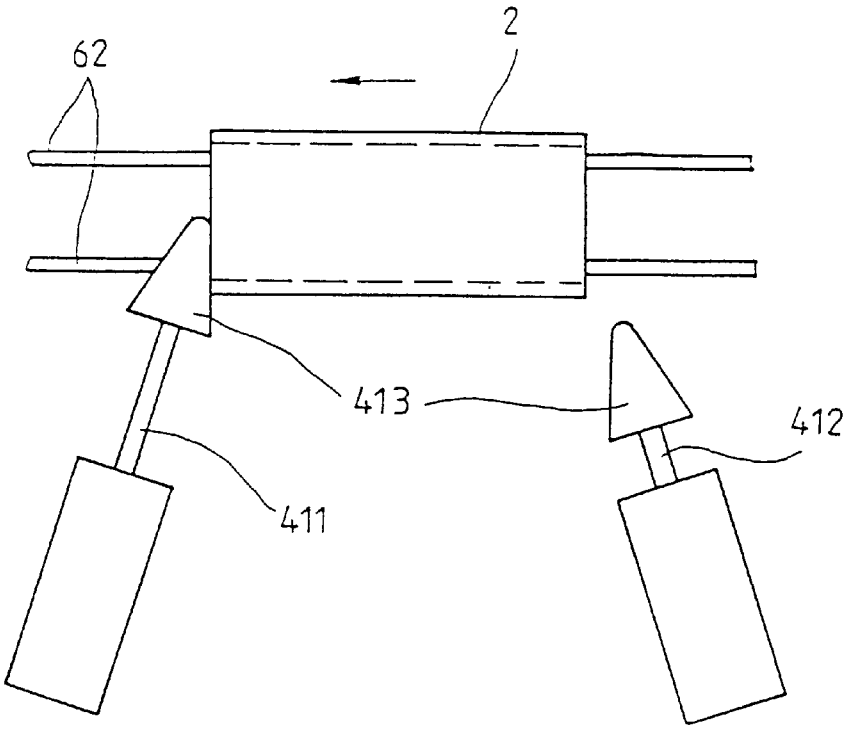
FIG. 4 is a stop means with stop pins equipped with conical means while stopping a tube.

One of the preferred embodiments of the stop pins 411, 412 with conical stops 413 is shown in FIGS. 4 and 5. In this embodiment, the axes of the stop pins 411, 412 form an acute angle and their mutually nearest surface lines are parallel due to the acute apex angle formed by the axes of the stop pins 411, 412.

The stop pins 411, 412 also can be made in another manner, for instance by not represented levers coupled with a drive mechanism and adapted to be turned against the front flange of the reserve tube 21 and against the rear flange of the reserve tube 21.

Figure 2:
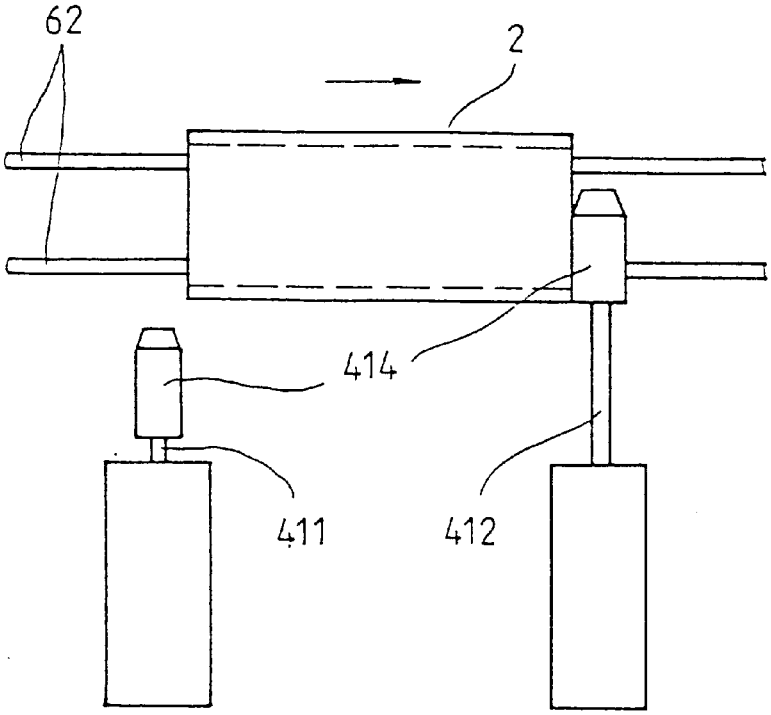
FIG. 2 is a stop means with stop pins equipped with cylindrical means while stopping a tube.
Figure 3:
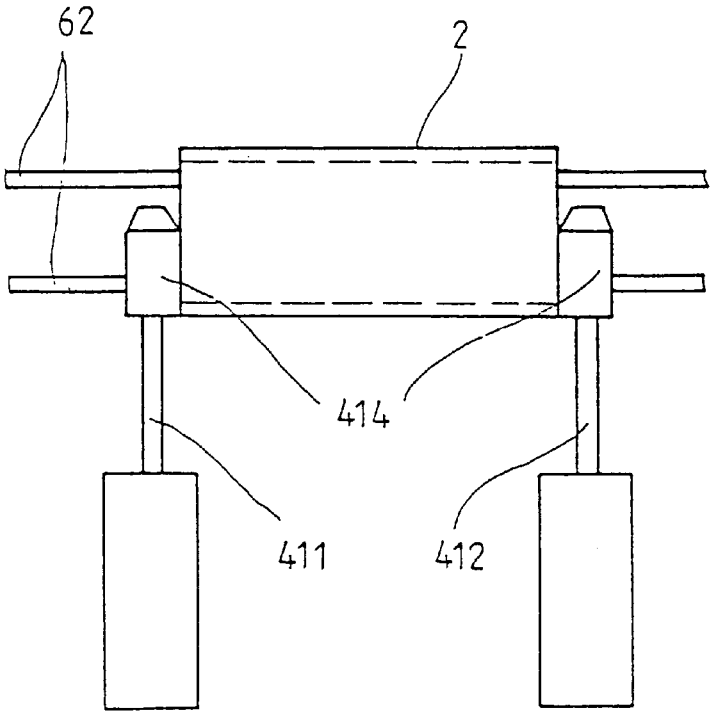
FIG. 3 is the stop means of the FIG. 2 with a positioned tube.

In the embodiment shown in FIGS. 2 and 3, the stop pins 411 and 412 are mounted in parallel and are fitted at their ends with cylindrical stops 414. The front part of these cylindrical stops 414 is fitted with run-up surfaces made in the represented embodiment as a part of a conical surface; however, they also can have another shape narrowing towards the front of the cylindrical stop 414. The minimum distance of the surface of the planes of the cylindrical stops 414 equals the length of the tube 2 and defines the position of the reserve tube 21 on the tube conveyer 6 after it has been gripped by the handling means 42 of the attending device 4.

In another, not shown embodiment the parallel stop pins 411, 412 can be fitted with conical stops 413. In this embodiment, the distance of the axes of the conical stops 413, or the distance of the axes of the stop pins 411, 412 respectively, is superior to the sum of the length of the tube 2 plus the maximum diameter of the conical stop 413. In the moved-out position of the stop pins 411, 412, the reserve tube 21 is gripped between the conical stops 413 and is pressed into a support provided for this purpose on the machine frame or on the tube conveyor 6.

Figure 6:
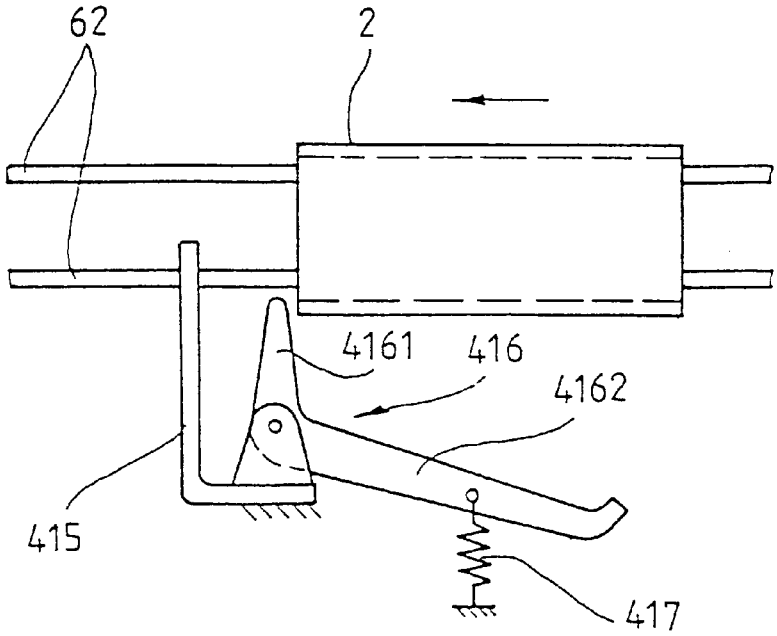
FIG. 6 is a stop means with a fixed stop with a stop lever while stopping a tube.

In the example of embodiment shown in FIG. 6, the stop means 41 of the reserve tube 21 consists of a fixed stop 415 mounted on the attending device 4 and protruding with its operating part into the path of travel of the reserve tube 21 on the tube conveyer 6. To the fixed stop 415 is related a double-arm stop lever 416 swingingly mounted on the attending device 4 or on the stop 415, and its contact arm 4161 projects in the rest position into the path of travel of the reserve tube 21 on the tube conveyer 6 while its defining arm 4162 lies in the rest position of the double-arm stop lever 416 outside said path. While traveling on the tube conveyer 6 towards the fixed stop 415, the reserve tube 21 hits the contact arm 4161 and turns the double-arm stop leaver 416 to the gripping position in which come to lie, first the front flange of the reserve tube 21 onto the fixed stop 415, and then the defining arm 4162 onto the rear flange of said reserve tube 21 and adjust the reserve tube 21 to a position permitting it to be gripped by the handling means 42. In the meantime, the contact arm 4161 gets outside the path of travel of the reserve tube 21 on the tube conveyer 6. In the shown embodiment there is fixed to the defining arm 4162 one end of an extension spring 417 whose other end is fixed to the attending device 4. The extension spring 417 serves to return the double-arm stop lever 416 to its rest position and to maintain it in this position, and can be replaced by another well-known means for maintaining the double-arm stop lever 416 in its rest position.

Figure 7:
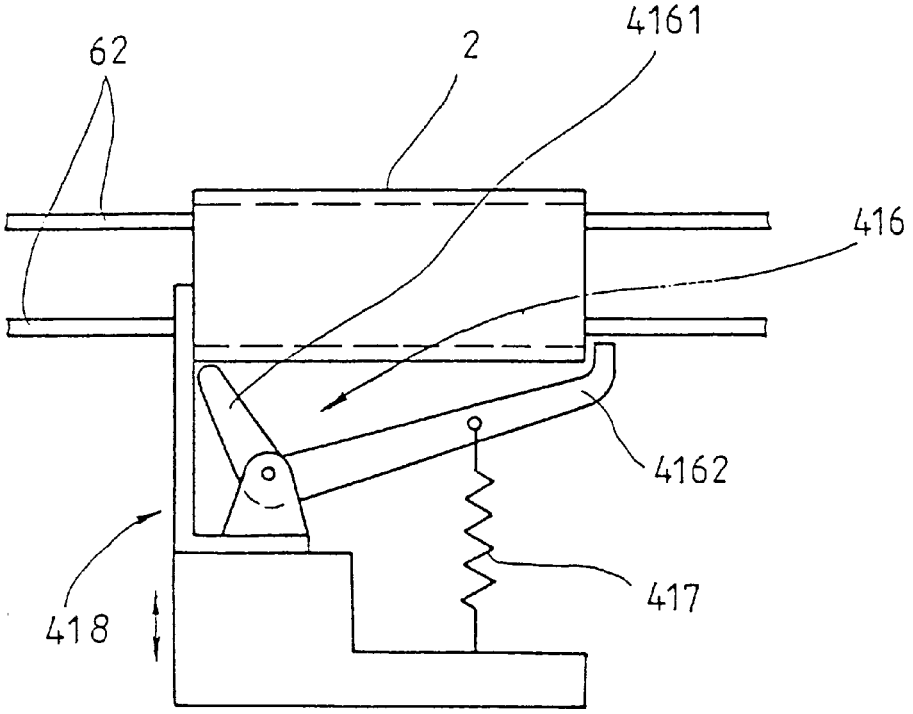
FIG. 7 is a stop means with a movable stop with a stop lever with a positioned tube.

In the embodiment shown in FIG. 7, the fixed stop 415 is replaced by a movable stop 418 mounted on the attending device 4 in the rest position outside the travel path of the reserve tube 21 on the tube conveyer 6 and protruding into said path in its moved-out position. On the movable stop 418 is swingingly mounted the double-arm stop lever 416 whose contact arm 4161 protrudes in the moved-out position of the movable stop 418 into the travel path of the reserve tube 21 on the tube conveyer 6. In the moved-out position of the movable stop 418, the defining arm 4162 lies outside the travel path of the reserve tube 21. Like in the embodiment shown in FIG. 6, the double-arm stop lever 416 is tilted by the reserve tube 21 passing along the double-arm stop lever 416 that is maintained in its rest position by means of the extension spring 417 whose one end is fixed to the double-arm stop lever 416 and whose the other end is fixed to the body of the movable stop 418.

The control unit 43 comprises well-known not represented storage elements receiving and storing for the required length of time due information, in particular information about the mutual position of the attending device 4 with respect to the reserve tube 21 lying on the tube conveyer 6. The control unit 43 also comprises well-known not represented logic elements adapted to evaluate, cancel or update the contents of the storage elements and to give orders to executive means coupled with the respective functional sections of the machine and of the attending device 4. In double-sided textile machines, the control unit 43 also monitors the information about the machine side the attending device 4 is just on, and at the same time stores by means of its storage elements the information received during its receding activity on the other side of the machine, in particular information about the position of the reserve tube 21 on the tube conveyer 6 if the reserve tube 21 really is on the tube conveyer 6, or information that there is no reserve tube 21 seated on the tube conveyer 6. When passing from one machine side attended to the other, the control unit 43 stores in the storage elements information about the machine side whose attendance it has just ended, and recalls information about the machine side whose attendance it begins. Such information can be ensured for instance by giving to each operating unit of the machine its tag representing from the point of view of the control its address consisting for instance of a number specifying among others the side of the machine on which the operating unit in question is situated; or the tags of the corresponding opposed operating units on the two machine sides can be identical and the control unit 43 receives information about the machine side change while the attending device 4 passes from one machine side to the other.

The tube conveyer 6 contains at least one endless belt 62 supported on at least two rollers 63, at least one of which is a driving roller coupled with the reversing drive 61 that is, in turn, connected with the control unit 43 of the attending device 4. To ensure perfect monitoring of the reverse tube 21, a sensor 64 monitoring the presence of the reserve tube 21 at the beginning of the tube conveyer 6 and connected to the control unit 43 of the attending device 4 can be related to the tube conveyer 6. In the embodiment shown in FIGS. 1 to 7, the endless belt 62 of the tube conveyer 6 consists of two parallel endless belts supporting the tube 2; however, it can be made in any other well-known manner.

Figure 9:
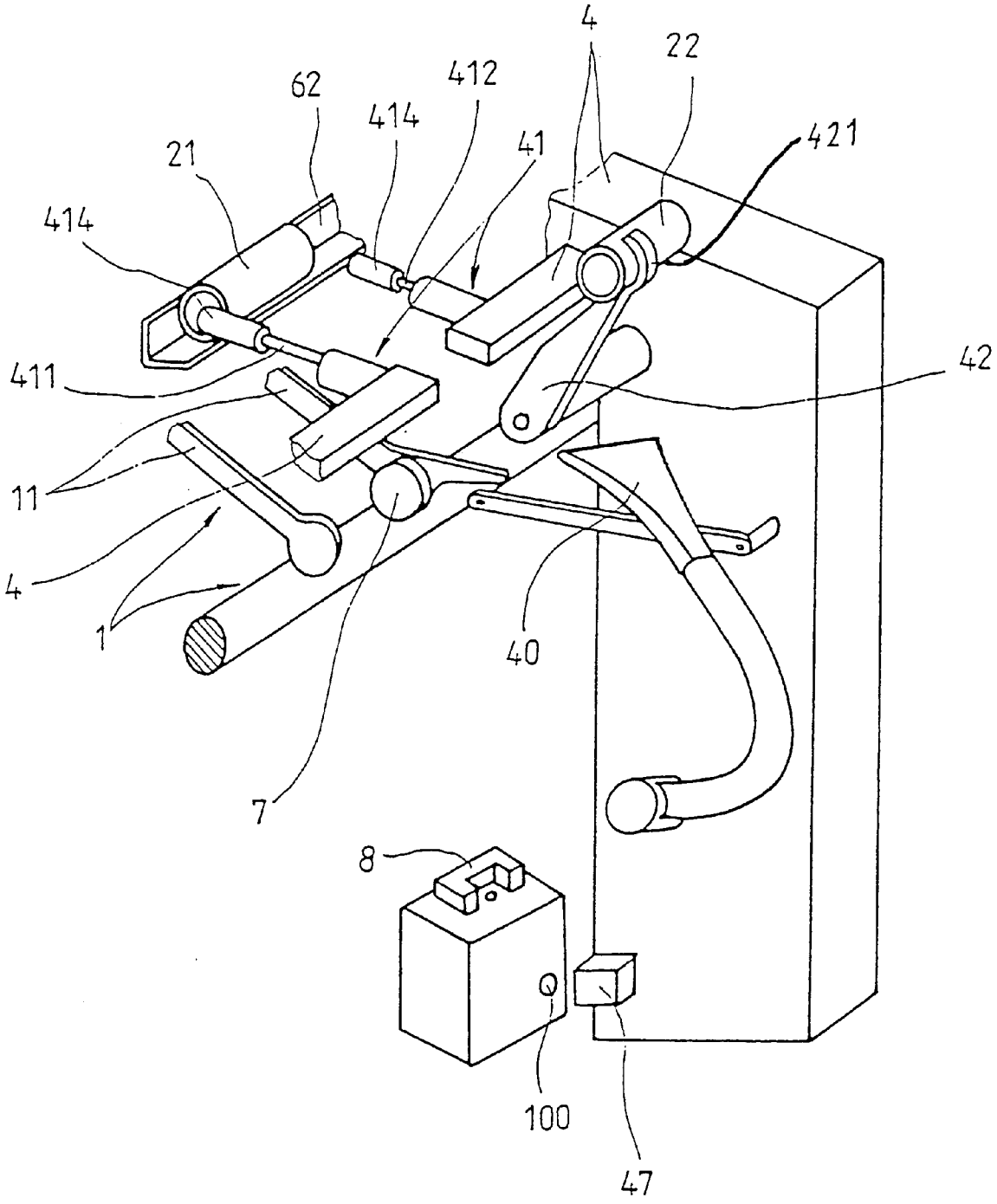
FIG. 9 is a view of a part of the attending device while attending an operating unit of the textile machine.
Figure 10:
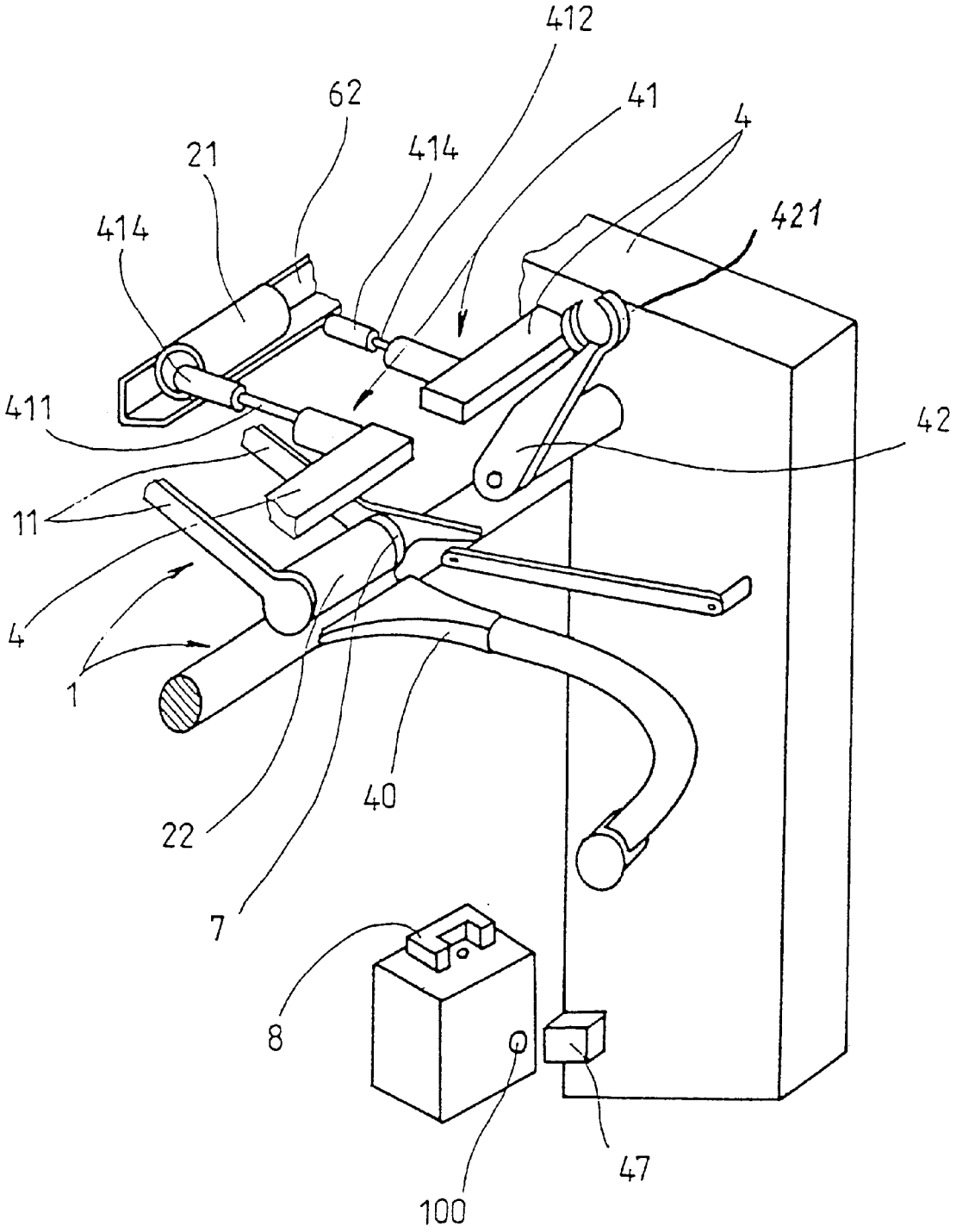
FIG. 10 shows an operating unit after an unsuccessful attempt at rewinding.

If some length of yarn, thread or another linear textile formation processed on a textile machine has been wound on the empty winding tube 22 during an unsuccessful attempt at restoring the winding, such textile linear formation must be removed from the winding tube 22, for instance by sucking off by means of a detecting (searching) jet 40 shown in FIGS. 9 and 10, arranged on the attending device 4, connected with a well-known not represented underpressure source and also serving to search for the end of a linear textile formation on a bobbin after its rupture during the winding.

The attending device 4 is equipped with a well-known communication device 47 which is connected with the control unit 43. Opposite the communication device 47 of the attending device 4 is provided on each operating unit of the machine a well known transmitter 100 of information about the condition of the operating unit storing at least the information that, either, the operating unit is functioning in its normal way or, on the contrary, that the operating process, i.e., including the winding, has been interrupted. In addition to this basic information, the transmitter can contain further items of information such as the address of the operating unit consisting for instance of the required number of the operating unit and the data about the respective machine side, or only of the serial no. of the operating unit out of which construction of the control unit 43 finds out the data about the respective machine side. The communication transfer between the information transmitter 100 on the operating unit of the machine and the communication device 47 of the attending device 4 is effected in a well-known wireless way, for instance by means of infrared radiation while the attending device 4 is traveling along the operating units of the machine. In case of need to transfer information from the attending device 4 to the operating unit of the machine, the information transmitter 100 on the operating unit of the machine is completed by a well-known not represented receiver. The information transmitter 100 can be situated on various parts of the operating unit of the machine, and the communication device 47 position on the attending device must ensure the possibility of its communication with the transmitter.

The attending device also contains a number of other well-known devices required to attend other functional parts of the respective machine; however, they are in no direct connection with the invention and are, therefore, neither represented nor described.

During the attendance of the operating units, the attending device 4 travels along the operating units of the respective machine side, receives information about their condition, and, in case of need, carries out due operations on the operating units. If a (fully) wound bobbin is to be replaced by an empty winding tube 22 or if no winding tube 22 is inserted in the winding device 1, it is the task of the attending device 4 to insert the winding tube 22 into the winding device 1 between the winding arms 11 and to attempt to resume the winding of the inserted empty winding tube 22. At the arrival of the attending device 4 to the operating unit to be attended, the winding tube 22 is seated in the handling means 42 of the attending device 4. After the arrival and the stop at such operating unit in need of attendance, the attending device first determines the requirements of the operating unit and begins to fulfill them. If it is required to insert the empty winding tube 22 into the winding device 1, the attending device 4 inserts between the winding arms 11 of the winding device 1 the empty winding tube 22 it has brought to the operating unit in need of attendance and seated in the handling means 42.

When the requirement to insert the empty winding tube 22 into the winding device 1 has been determined, the attending device must ensure that the reserve tube 21 is in due time, considered from the point of view of the operating cycle, present in the stop means 41. This can be realized in many ways taking into account the operating cycle of the attending device 4 and the speed of the tube conveyer 6, but in all variants the tubes 2 held in the tube container 5 must be laid on the tube conveyer 6 and conveyed by it to the attending device 4.

In one of the variants, the control unit 43 monitors the presence of the reserve tube 21 on the tube conveyer 6 and for instance on the basis of the addresses of the operating units remembers or determines in what direction from the attended operating unit the reserve tube 21 on the tube conveyer 6 lies and gives to the reserving drive 61 of the tube conveyer 6 a signal to rotate in the required direction so as to bring the reserve tube 21 on the tube conveyer 6 to the attending device 4. If there is no reserve tube 21 present on the tube conveyer 6, the attending device 4 asks for a tube 2 from the tube container 5, the tube 2 is released from it and placed on the tube conveyer 6 that conveys it as the reserve tube 21 to the attending device 4. The attending device 4 stops the reserve tube 21 on the tube conveyer 6 with the stop means 41 and gives a signal to stop the tube conveyer 6. The stop of the tube conveyer 6 can take place also after a time interval to be determined by the control unit 43 on the basis of the mutual position between the attending device 4 with respect to the tube container 5.

In the process of stopping of the reserve tube 21 on the tube conveyer 6, either the left-side or the right-side stop pin 411 or 412, depending on the side from which the reserve tube 21 on the tube conveyer 6 comes towards the attending device 4, is moved out into the path of travel of the reserve tube 21. For instance, if the reserve tube 21 on the tube conveyer 6 comes from the right side of the attending device 4, as shown in FIG. 5, moved out into the travel path of the reserve tube 2 is the left-side stop pin 411 on whose stop, in the shown example the conical stop 413, comes to lie the front flange of the called-in reserve tube 21 and the reserve tube 21 gets stopped. After the called-in reserve tube 21 has been stopped, the right-side stop pin 412 moves out, and its stop, in the shown example the conical stop 413, comes to lie on the rear flange of the called-in reserve tube 21 and presses the reserve tube 21 to the stop of the left-side stop pin 411 so that the reserve tube 21 is firmly gripped between and exactly positioned in the gripping position to be gripped by the handling means 42 of the attending device 4. In this way, both cylindrical and conical reserve tubes 21 can be stopped and fixed between the stop pins 411, 412 irrespective of whether the conical reserve tube 21 coming to the stop means 41 of the attending device 4 is turned to it by its larger or smaller diameter.

If the reserve tube 21 comes to the attending device 4 from the opposite side, i.e., the left one, as shown in FIG. 2, it is the right-side stop pin 412 fitted in this case with a cylindrical stop 414 that moves out into its travel path first. After being stopped, the reserve tube 21 on the conveyer 6 is fixed by the stop, in the represented example by the cylindrical stop 414 of the left-side stop pin 411. This means that the called-in reserve tube 21 on the tube conveyer 6 is braked by the stop pin 411 or 412 which lies farther in the direction of its travel to the attending device 4 and that after its stop it is by the other stop pin 412 or 411 positioned to its gripping position on the tube conveyer 6.

After the insertion of the winding tube 22 into the winding arms 11 of the winding device 1, the attending device 4 makes an attempt to restore (resume) the yarn winding in the winding device 1 on the empty winding tube 22 which, for instance in the rotor spinning machine, means to place some length of ancillary yarn in one of the well-known ways between the spinning unit and the winding device 1 with the prepared winding tube 22, to insert the spinning-in end of the ancillary yarn into a not represented rotor, and to start the winding of the yarn 7 on the winding tube 22 in the winding device 1 of the machine.

In case of a successful attempt at the winding resumption reported to the attending device 4 by the related well-known sensors 8 of the yarn 7 presence situated on the operating unit of the machine or by well-known not represented sensors situated on the attending device 4, the handling means 42 turns with its gripping part towards the tube conveyer 6 and grips with its grip member 421 and the prepared reserve tube 21 fixed between the stop pins 411 and 412 of the stop means 41 on the conveyer 6 whereupon it turns back to its transport position. The attending device 4 is then ready to leave the attending operating unit and to travel to a next operating unit.

A new empty tube 2 taken from the tube container 5 is then laid on the tube conveyer 6, in this version at least after the stop of the attending device 4 at the next operating unit and after determine that the insertion of an empty winding tube 22 into the winding device 1 is required.

If the attempt to restore the winding has been unsuccessful the handling means 42 returns to the winding tube 22 inserted between the winding arms 11 of the winding device 1, grips it and takes it out of the winding device 1. Before or after that, the attending device 4 removes from this winding tube 22 in a well-known manner the yarn 7 if some yarn 7 has been wound on it. If some length of the yarn 7 is wound on the winding tube 22 during the attempt to restore the winding, it is wound into a ring near one flange of the winding tube 22 where a reserve of the yarn 7 is being formed. This length of the yarn 7 is short and can by easily removed by suction, for instance by a detecting (searching) jet 40 that is brought near the winding tube 22 either while the latter is mounted in the winding device 1 or after it is removed by the handling means 42 of the attending device 4. The attending device 4 can repeat several times the insertion of the winding tube 22 into the winding device 1, and it can also after each repetition make an attempt to restore the winding. If even the last attempt programmed has been unsuccessful, it is ended by taking the winding tube 22 out of the winding device 1 with previous or subsequent removal of possible yarn 7 and displacing the handling means 42 with the winding tube 22 to its transport position. At the same time, the stop means 41 of the attending device 4 releases the reserve tube 21 on the tube conveyer 6 by retracting the two stop pins 411, 412, and leaves this reserve tube 21 lying freely on the tube conveyer 6. The attending device 4 is now ready to leave the attended operating unit and to move to another operating unit.

The control unit 43 of the attending device 4 monitors the direction in which the attending device 4 moves from the operating unit it is leaving, and thus gets information about in what direction from the attending device 4 is situated the reserve tube 21 placed on the tube conveyer 6, i.e., it monitors the mutual position of the attending device 4 and of the reserve tube 21 on the tube conveyer 6 according to which it selects the direction of travel on the machine side in question when the control unit 43 calls the reserve tube 21 to the attending device 4. When passing from one machine side to the other, the control unit 43 of the attending device 4 stores information about the position of the reserve tube 21 on the machine side whose attendance it has just finished, and recalls such information about the machine side it is beginning to attend.

If the attending device 4 needs an empty winding tube 22 for attending a following operating unit, its control unit 43 gives out to the reversing drive 61 of the tube conveyer 6 an order to convey the reserve tube 21 with the conveyer 6 towards the attending device 4. In the meantime, the attending device 4 prepares the respective stop pin 411 or 412 for stopping the reserve tube 21 and then fixes the stopped reserve tube 21 on the tube conveyer 6 by moving out the other stop pin 412 or 411.

In another variant of the method of supplying empty tubes 2 to winding devices of a textile machine, in case of an unsuccessful attempt to restore the winding on an operating unit, all steps are carried out like in the preceding variant but after the reserve tube 21 on the tube conveyer 6 has been released from its fixing between the stop pins 411, 412 of the stop means 41 and left lying freely on the tube conveyer 6, and attending device 4 begins to travel to attend another operating unit, the reversing drive 61 of the tube conveyer 6 receives from the control unit 43 an order to reverse run, begins to move back, puts the reserve tube 21 at its beginning, and then stops. In this variant, the attending device 4 need not monitor its own position with respect to that of the reserve tube 21 on the tube conveyer 6 and the reserve tube 21, when asked for, moves to it invariably from the beginning of the conveyer 6.

In this variant, a new tube 2 from the tube container 5 can be laid on the tube conveyer 6 either immediately after the reserve tube 21 has been taken from the tube conveyer 6 or in the same manner as the preceding variant.

In another variant of the method of supplying empty tubes 2 to winding devices of a textile machine, in case of an unsuccessful attempt to restore the winding, the reserve tube 21 will be released from gripping by the stop pins 411, 412 of the attending device 4 and the tube conveyer 6 begins to move in the same direction as the attending device 4 so that the reserve tube 21 then freely lying on the tube conveyer 6 follows the attending device 4. The reversing drive of the tube conveyer 6 can be put in action in the due direction as soon as the attending device 4 begins to move, and the reserve tube 21 on the tube conveyer 6 is constantly braked by the moved-out due stop pin 411 or 412 while the other stop pin 412 or 411 is retracted.

In this case, the attending device 4 carries the reserve tube 21 at all times with it. After a next operating unit in need of attendance has been arrived at, the reserve tube 21 can be set, by moving out the other stop pin 412 or 411, to its gripping position in which it is ready to be gripped by the handling means 42 of the attending device 4 in case of a successful attempt to restore the winding on the empty winding tube 22. Analogically to the preceding variants, after the reserve tube 21 has been taken from the tube conveyer 6, another empty tube 2 from the tube container 5 is put at a suitable moment on the tube conveyer 6, and at a suitable time conveyed to the attending device 4.

To avoid the risk of the reserve tube 21 falling out, which in the preceding version is during the travel of the attending device 4, by the movement of the tube conveyer 6 constantly pressed towards the stop of the related stop pin 411 or 412 and by means of this stop pin 411 or 412 braked, another variant of the invention entails fixing the reserve tube 21 in its gripping position in the stop means 41 of the attending device 4 so that it is during the travel of the attending device 4 moved in the stop means 41 on the tube conveyer 6.

In single-sided machines as well as in double-sided machines in which each side is attended by an independent attending device 4, all variants of embodiment of stop means 41 are applicable because the reserve tubes 21 are fed to the attending device 4 in each case from one and the same side of the attending device 4. In double-sided machines attended by only one attending device 4, only such stop means 41 are applicable into which the reserve tubes 21 can be led from each side.

It is immaterial whether the two tubes 21, 22 have been put into the attending device 4 by the operator at the machine start or whether the two tubes 21, 22 have been put into it, one after another, by the tube conveyer 6 form the tube container 5.

After a successful attempt to restore winding on the empty winding tube 22, the handling means 42 grips the reserve tube 21 fixed between the stop pins 411, 412 in the gripping position. The following removal of the reserve tube 21 from the tube conveyer 6 is evaluated by the control unit 43 of the attending device 4 as an absence of the reserve tube 21 no the tube conveyer 6. The missing reserve tube 21 can be completed into the tube conveyer 6 from the tube container 5 immediately after being gripped and removed from the tube conveyer 6 or in another time sequence according to one of the above described methods (versions).

This method permits reducing the length of time for which the attending device 4 is on the attended operating unit, because even the remotest machine part (operating unit) is not threatened by the risk that the reserve tube 21 asked for (called in) should not reach the attending device 4 in time.

Some types of attending device 4, not represented, use for transporting the tube 2 between the tube conveyer 6 and the winding device 1 two mechanisms, i.e., a transporting mechanism used to grip the reserve tube 21 on the tube conveyer 6 and to transport it to a special delivery intermediate position in which the tube receives exact positioning and is handed over to an inserting mechanism that inserts it between the winding arms 11 of the winding device 1 as the winding tube 22. After an unsuccessful attempt to restore the winding, this winding tube 22 is taken out of the winding device 1 by means of said inserting mechanism.

After an unsuccessful attempt to restore the winding, the winding tube 22 can be taken out of the winding device also by a device arranged specially for this purpose on the attending device 4. However, such device appears to be superfluous because the mechanisms serving to insert the winding tube 22 into the winding device 1 can be used also, sometimes after a modification, to take the winding tube 22 out. In any case, the winding tube 22 is taken out of the winding device 1 by a mechanism which is a part of the attending device 4.

In another method of supplying empty tubes 2 to winding devices of a textile machine, the winding tube 22 is located in the handling means 42 at the latest before the beginning of the winding tube 22 insertion into the winding device 1. The empty reserve tube 21 is sent from the tube container 5 only after the attempt to restore the winding has been qualified as successful, for instance by a signal of the sensor 8 of the presence of yarn 7. Then, the empty reserve tube 21 is stopped and positioned by the stop means 41 of the attending device 4, gripped by the handling means 42 of the attending device 4 either during the travel of the attending device 4 to the next operating unit of the machine in need of attendance or after the arrival of the attending device 4 at the next operating unit of the machine so that the winding tube 22 is ready in the handling means 42 of the attending device before the beginning of the process of inserting the winding tube 22 into the winding device 1. If the attempt to restore the winding has been unsuccessful, the winding tube 22 is taken out of the winding device 1 and analogically to the preceding methods (versions) prepared for a next inserting into the winding device 1. If at an attended operating unit of the machine fails a predetermined number of subsequent attempts to restore the winding, this winding tube 22 remains in the handling means 42 of the attending device 4 and shares its travel to a next operating unit in need of attendance. This cycle is repeated up to a successful attempt to restore the winding of yarn 7 on the inserted empty winding tube 22; then, another empty tube 2 is sent to the attending device from the tube container 5. This method can be applied in textile machines equipped with rapid tube conveyers 6.

It should be apparent to those skilled in the art that various modifications and variations can be made in the present invention without departing from the scope and spirit of the invention. For example, features illustrated or described as part of one embodiment can be used on another embodiment to yield a still further embodiment. It is intended that the present invention cover such modifications and variations as come within the scope of the appended claims and their equivalents.

We claim:

1. A method for supplying empty tubes to winding devices of a textile machine which has a plurality of operating units adjacently disposed in a line with each operating unit having a winding device, the textile machine also having a tube container at one end thereof with a conveyor disposed along the line of operating units for delivering tubes from the tube container to the operating units, the textile machine further including a traveling attending unit adapted to travel alongside the operating units, the attending unit also including a handling device, said method comprising:

conveying empty tubes from the tube container along the conveyor to the attending unit and transferring the empty tube from the conveyor to the handling device;

positioning the attending unit at an operating unit in need of the empty tube prior to or after said conveying step and transferring the empty tube from the attending unit to the operating unit winding device with the attending unit handling device after said conveying step;

maintaining the attending unit at the operating unit while the operating unit attempts to restore winding operations using the empty tube transferred from the handling device to the winding device; and removing the empty tube from the operating unit winding device with the attending unit handling device if the operating unit is unsuccessful in restoring winding operations after a predetermined number of attempts.

2. The method as in claim 1, comprising conveying the empty tube to the attending unit prior to the attending unit arriving at the operating unit in need of the empty tube to restore winding operations.

3. The method as in claim 1, further comprising retaining the empty tube in the attending unit handling device once the tube is removed from the winding device after the unsuccessful restoration of winding operations, and delivering the empty tube with the attending unit to another operating unit in need of an empty tube to restore winding operations.

4. The method as in claim 1, further comprising removing any textile material wound onto the empty tube during the unsuccessful attempts at restoring winding operations at the operating unit.

5. The method as in claim 4, wherein the textile material is removed from the empty tube after the empty tube has been removed from the operating unit winding device.

6. The method as in claim 4, wherein the textile material is removed from the empty tube before the empty tube is removed from the operating unit winding device.

7. The method as in claim 4, comprising removing the textile material from the empty tube with a suction device.

8. The method as in claim 1, further comprising:

conveying a reserve tube from the tube container to the attending unit;

stopping the reserve tube on the conveyor at the attending unit with stop devices on the attending unit;

releasing the reserve tube from the attending unit stop devices after the unsuccessful attempts at restoring winding operations and keeping the reserve tube seated on the conveyor;

retaining the empty tube in the attending unit handling device once the tube is removed from the winding device after the unsuccessful restoration of winding operations, and delivering the empty tube with the attending unit to another operating unit in need of an empty tube to restore winding operations;

after the attending unit has used the empty tube at successful restoration of winding operations at the other operating unit, transferring the reserve tube from the conveyor to the attending unit handling device wherein the reserve tube can be used at another operating unit.

9. The method as in claim 8, further comprising moving the reserve tube to a beginning of the conveyor once released from the attending unit stop devices and maintaining the reserve tube at the beginning of the conveyor until called for by the attending unit after the empty tube has been used in successful restoration of winding operations at another operating unit.

10. The method as in claim 8, further comprising maintaining the reserve tube in its position on the conveyor once released from the attending unit stop devices and subsequently moving the reserve tube to the attending unit with the conveyor in a direction determined by the position of the attending unit relative to the reserve tube after the empty tube has been used in successful restoration of winding operations at another operating unit.

11. The method as in claim 8, further comprising having the reserve tube follow the attending unit on the conveyor once released from the attending unit stop devices and stopping the reserve tube at each operating unit attended to by the attending unit with the stop devices until the empty tube is used in successful restoration of winding operations at an operating unit and the reserve tube is transferred to the attending unit handling device from the stop devices.

12. The method as in claim 1, further comprising:

conveying a reserve tube from the tube container to the attending unit;

stopping the reserve tube on the conveyor at the attending unit with stop devices on the attending unit;

maintaining the reserve tube held by the stop devices after the unsuccessful attempts at restoring winding operations;

retaining the empty tube in the attending unit handling device once the tube is removed from the winding device after the unsuccessful restoration of winding operations, and delivering the empty tube in the handling device and the reserve tube held by the stop devices to another operating unit in need of an empty tube to restore winding operations;

after the attending unit has used the empty tube in the handling device in a successful restoration of winding operations at the other operating unit, transferring the reserve tube from the stop devices to the handling device.

13. The method as in claim 12, further comprising placing another reserve tube on the conveyor after the first reserve tube has been transferred to the handling device.

14. The method as in claim 13, comprising placing the other reserve tube on the conveyor after the attending unit has arrived at the next operating unit to be attended to.

* * * * *